United States Patent [19]

Crandell

[11] Patent Number: 4,938,469

[45] Date of Patent: Jul. 3, 1990

[54] AQUATIC EXERCISE APPARATUS

[75] Inventor: Raymond H. Crandell, Phoenix, Ariz.

[73] Assignee: Conray Company, Phoenix, Ariz.

[21] Appl. No.: 312,207

[22] Filed: Feb. 21, 1989

[51] Int. Cl.[5] ..... A63B 22/02

[52] U.S. Cl. ..... 272/69; 272/70; 128/25 R; 119/29; 4/492

[58] Field of Search ..... 272/69, 70, 96; 128/25 R, 25 B; 119/29; 4/488, 492, 496, 544

[56] References Cited

U.S. PATENT DOCUMENTS

| | | | |
|---|---|---|---|
| 2,417,499 | 3/1947 | Ille | 4/492 X |
| 3,485,213 | 12/1969 | Scanlon | 119/29 |
| 3,606,320 | 9/1971 | Erwin, Jr. | 272/69 |
| 4,197,815 | 4/1980 | Brazelton | 119/29 |
| 4,332,217 | 6/1982 | Davis | 272/69 X |
| 4,466,141 | 8/1984 | Starkey | 4/488 |
| 4,502,679 | 3/1985 | De Lorenzo | 272/69 |
| 4,574,739 | 3/1986 | Fontaine et al. | 119/29 |
| 4,576,376 | 3/1986 | Miller | 272/69 |
| 4,712,788 | 12/1987 | Gaudreau, Jr. | 272/69 |

FOREIGN PATENT DOCUMENTS

| | | | |
|---|---|---|---|
| 2710948 | 9/1978 | Fed. Rep. of Germany | 128/66 |

OTHER PUBLICATIONS

"Aquaciser" by D. L. Hansen, Inc., 2/12/87.

*Primary Examiner*—Richard J. Apley
*Assistant Examiner*—Joe H. Cheng
*Attorney, Agent, or Firm*—LaValle D. Ptak

[57] ABSTRACT

An aquatic exercising and therapeutic apparatus includes a relatively narrow rectangular tank for retaining water in it to a selected depth. A treadmill is located in the bottom of the tank beneath the level of the liquid and extends from end to end. A pump system provides a moving stream of water, recirculating from one end of the tank to the other; so that by varying the speed at which the treadmill is operated, as well as the flow rate of water provided by the pump, varying levels of intensity are provided for a workout in the tank. For a fitness or conditioning training, the treadmill and the water flow typically are in the same direction to increase the level of workout. For therapeutic purposes, such as assisting a patient to walk after hip surgery or the like, the treadmill is operated in one direction and the water flow in the other.

26 Claims, 4 Drawing Sheets

FIG. 1
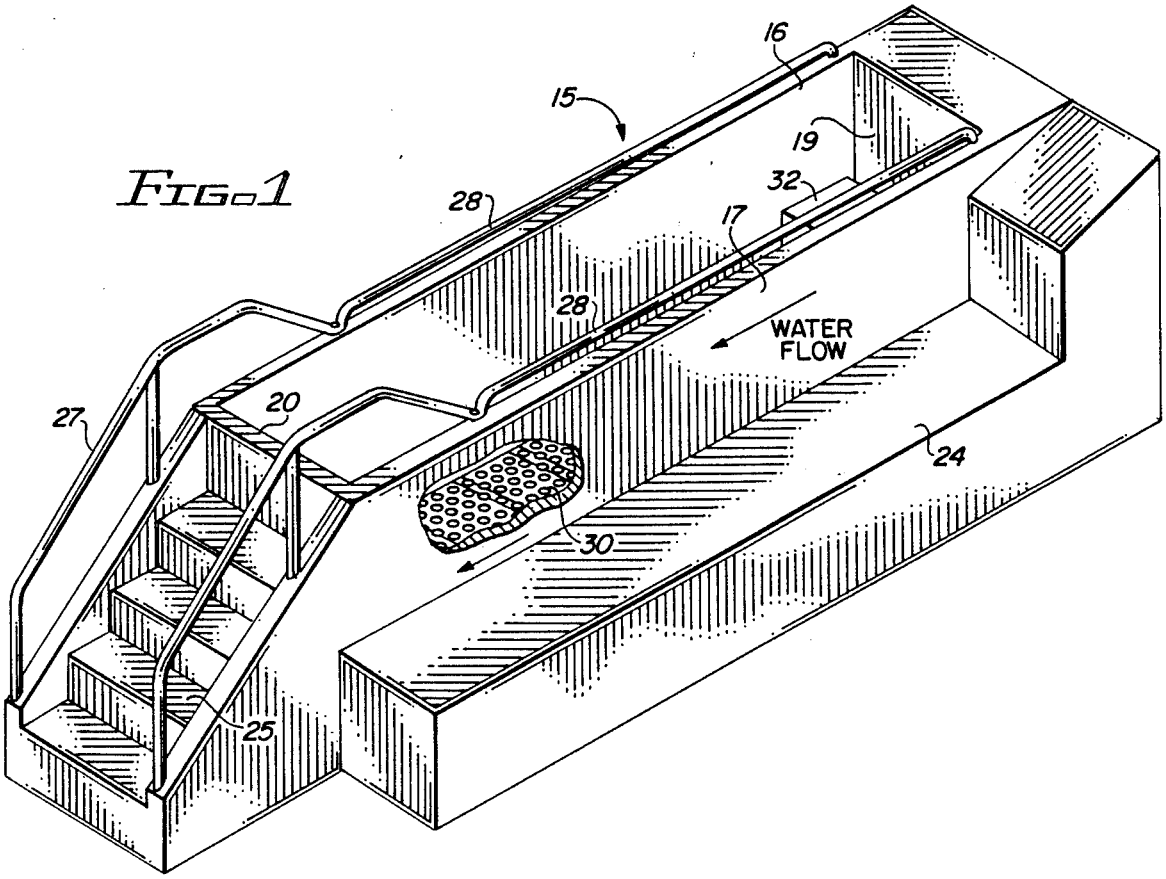
FIG. 3
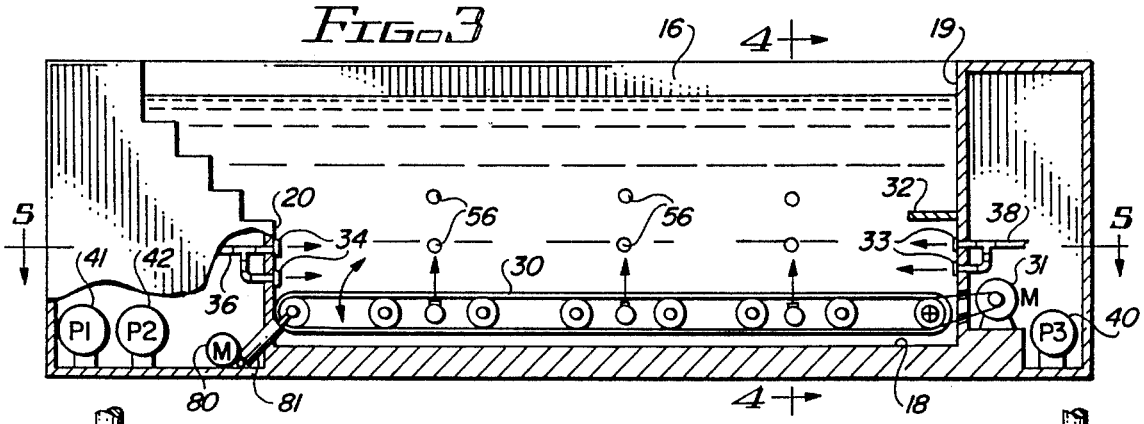
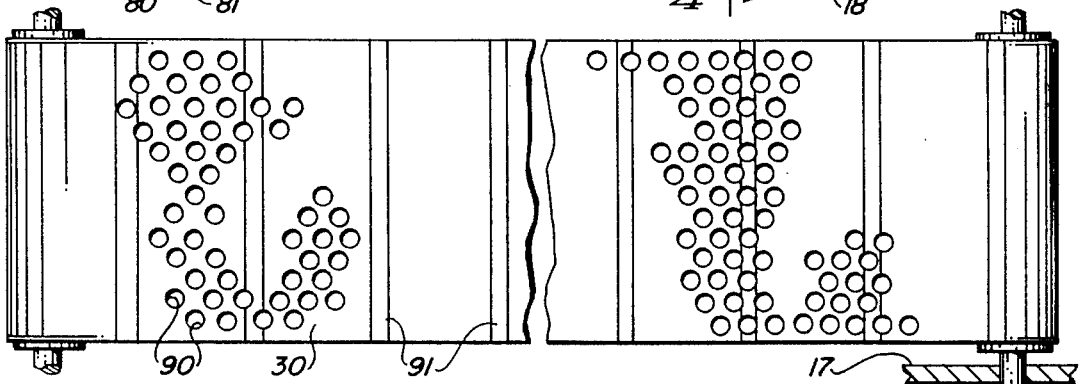
FIG. 6

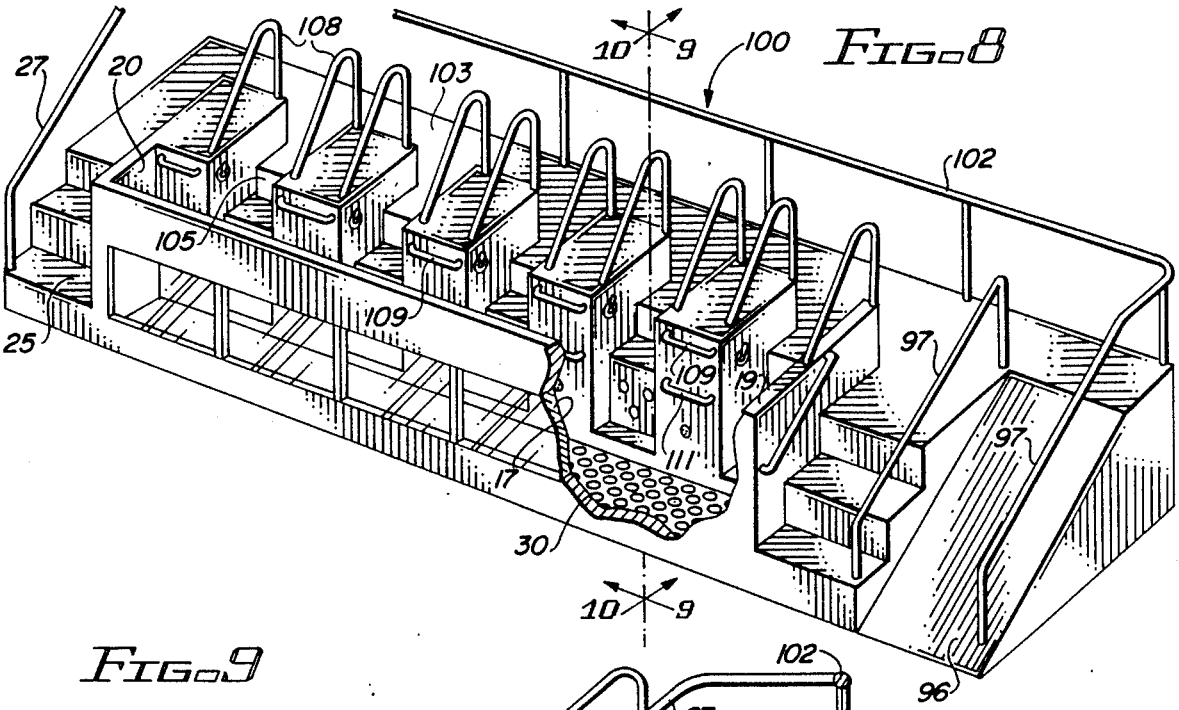
FIG. 8
FIG. 9
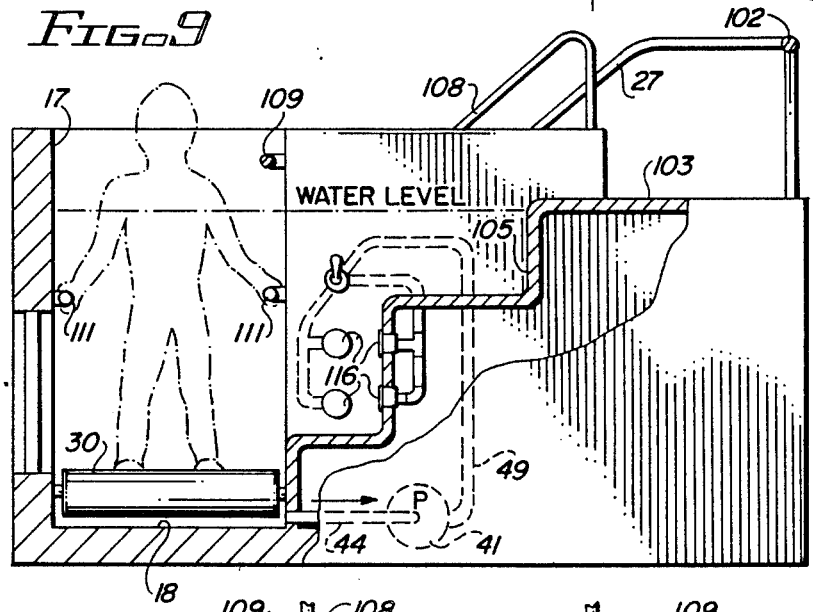
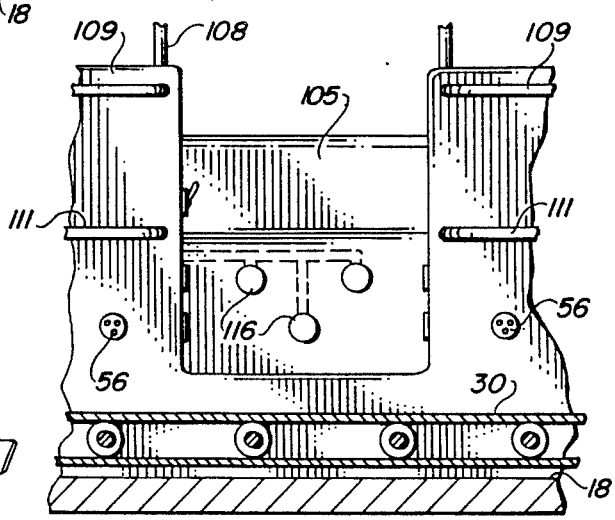
FIG. 10

AQUATIC EXERCISE APPARATUS

BACKGROUND

In the exercise and fitness field, various devices have been developed to enable persons to exercise and maintain physical fitness in relatively confined spaces. While outdoor jogging is a popular method of keeping fit, outdoor jogging has many disadvantages, including inclement weather, traffic, unavailability of good running surfaces, and the like. Other types of outdoor activity, such as tennis, racketball and team sports require interaction with other persons and also require a relatively large amount of space. Consequently, compact fitness machines of different types have been developed for use in relatively small rooms or small spaces for enabling persons to maintain a full fitness or exercise program which is not subject to weather variations, availability of team partners or the like.

Similarly, needs exist for therapeutic rehabilitation equipment for assisting physical therapists in rehabilitating persons who have undergone knee surgery, hip surgery and the like, as well as assisting stroke victims and other physically impaired persons in exercise recovery and rehabilitation programs.

One type of exercise machine which has become relatively popular, both for athletes and in rehabilitation programs, is a stationary treadmill which employs a motor driven endless belt on which the user may walk or run in place, depending upon the speed of operation of the treadmill belt. Standard treadmills, however, still require the entire weight of the person to be carried by the legs and feet of the user, with the advantage being that a treadmill may be used to provide walking or running exercise indoors in a limited space.

Underwater treadmills have been developed for use in training and therapeutic exercise of horses. Two patents disclosing underwater treadmills for horses, are the Scanlon U.S. Pat. #3,485,213 and Davis U.S. Pat. #4,332,217. Both of these patents are directed to devices in which a water filled tank is provided with a treademill on its bottom. The treadmill may be operated at various speeds to adjust or control the level of workout provided for the horses. The water may be used to apply a buoyant force on the animal to reduce concussive forces, if desired. The depth of the water may be varied to change the resistance to movement of the limbs of the horses for controlling the workout or stress level for a desired training program.

The Brazelton U.S. Pat. #4,197,815 discloses a tank for exercising horses by swimming. A relatively small tank is used, and a water flow rate is established from one end of the tank to the other by means of pumps. There is no treadmill in the tank, and the depth of the water is selected to be sufficiently deep to force the horse to swim.

The Fontaine U.S. Pat. #4,574,739 also is directed to a horse exercising device comprising a water tank with a treadmill located in its bottom. The treadmill, however, is vertically adjustable to permit the horse to walk onto the treadmill while it is located above the water. The treadmill then is lowered into the water to the desired depth. In all other respects the treadmill disclosed in the Fontaine Patent operates in a manner similar to the treadmills of the Scanlon and Davis Patents discussed above.

The Gaudreau, Jr. U.S. Pat. #4,712,788 is directed to an aquatic exercise apparatus for people. This apparatus is somewhat similar in structure to the one disclosed in the Fontaine Patent, but it is mounted adjacent the edge of a swimming pool. A treadmill surface is located, in its upper position, in a plane substantially parallel to the plane of the deck surrounding the pool. The user then moves onto the treadmill which is lowered to a desired depth in the pool. Specifically, the device is structured to permit a wheelchair user to wheel onto a platform adjacent the moving treadmill part; and the platform and treadmill both are lowered together to the desired depth. Buoyancy provided by the water permits the user to get out of the wheelchair and begin exercising and, after exercising, get back into the wheelchair while the entire platform is underwater. After the user is back in the wheelchair, the platform is raised to its original position to permit the user to exit the platform onto the deck surrounding the pool.

It is desirable to provide an aquatic exercise and rehabilitation system which provides the advantages of the various known prior art devices and which further is capable of use for athlete fitness workouts, as well as, rehabilitation uses and which is superior in operation and more flexible in application than the devices and systems of the prior art.

SUMMARY OF THE INVENTION

Accordingly, it is an object of this invention to provide an improved exercise apparatus.

It is another object of this invention to provide an improved treadmill exercise apparatus.

It is an additional object of this invention to provide an improved underwater treadmill apparatus.

It is a further object of this invention to provide an improved underwater treadmill apparatus which employs a combination of a moving treadmill and a moving water stream for establishing the level of workout of the user of the apparatus.

In accordance with the preferred embodiment of the invention, an exercising and therapeutic apparatus includes a container or pool for retaining water to a desired depth. A treadmill is located in the bottom of the container beneath the water and provides a moving support surface for the user of the apparatus. Water flow from one end of the container to the other is provided in addition to the movement of the treadmill for controlling the level of workout. In a more specific embodiment of the invention, the relative directions of the water flow and treadmill movement may be changed from movement in the same direction to movement in the opposite direction to provide maximum flexibility to the uses which may be made of the apparatus.

BRIEF DESCRIPTION OF THE DRAWINGS

FIGS. 1 and 2 are perspective views of two variations of a preferred embodiment of the invention;

FIG. 3 is a cross-sectional side view of the embodiment of FIG. 1;

FIG. 6 is a top view of a portion of the embodiment of FIGS. 1 through 5;

FIG. 8 is a partially cutaway perspective view of another embodiment of the invention;

FIG. 9 is a cross-sectional view taken along the line 9—9 of FIG. 8; and

FIG. 10 is a cross-sectional view of a portion of the embodiment of FIG. 8 taken along the line 10—10 of FIG. 8.

DETAILED DESCRIPTION

Figure 2:
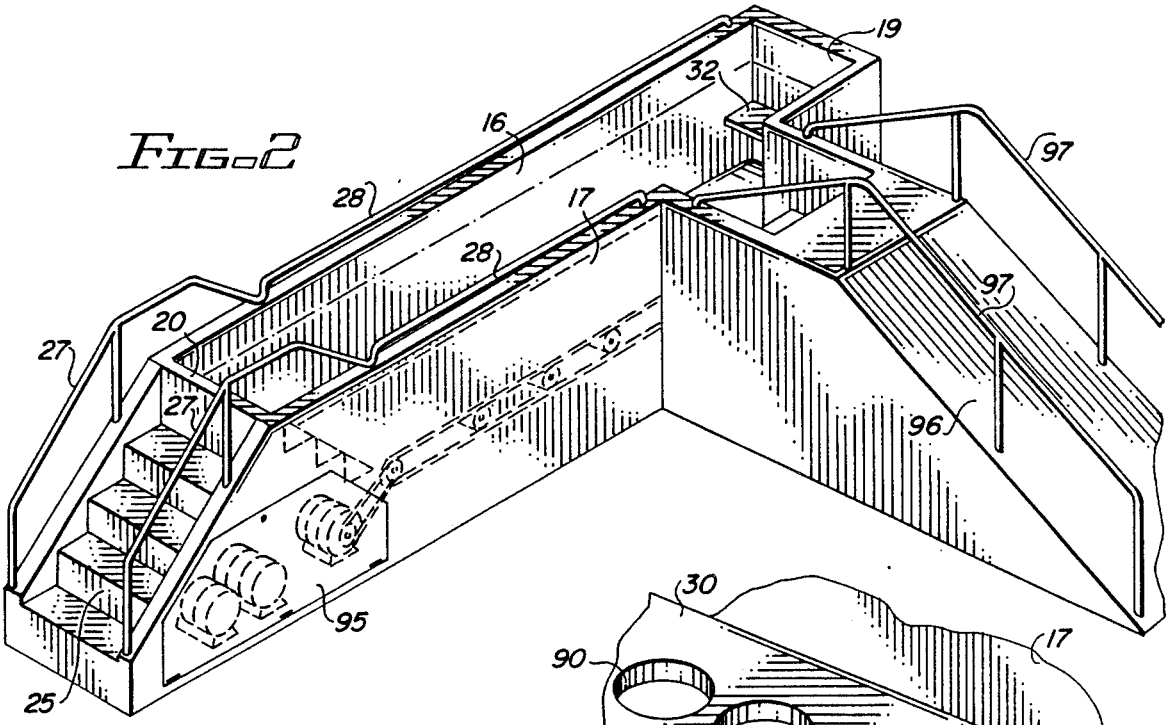

Reference now should be made to the drawings in which the same reference numbers are used throughout the different figures to designate the same components. FIGS. 1 and 2 illustrate two variations of a preferred embodiment of the invention. The aquatic exercise and therapeutic apparatus which is disclosed in these figures comprises an elongated, rectangularly shaped water tank or pool 15 which, as illustrated in FIGS. 1 and 2, is approximately 20' long, 5' wide and 5' high, with handrailing, at the highest point on the left-hand end of the tank in FIG. 1 and on both of the entry places in FIG. 2, extending approximately twenty-four inches (24") above the top of the tank. The tank 15 comprises first and second vertical sides 16 and 17 and is enclosed at the ends by vertical walls 19 and 20. On the left-hand or entrance end of the tanks in both FIGS. 1 and 2, descending stairs also comprise part of the end wall 20, as illustrated most clearly in FIG. 3. The bottom of the tank 18 completes the tank structure. The tank itself may be made of any suitable materials. Typically, for an installation in a hospital or athletic facility, it is made of stainless steel. The tank, however, could be made of poured concrete or other suitable materials, as desired.

Entry steps 25 are provided at the left-hand end of the tank in both FIGS. 1 and 2, and handrails 27 extend on both sides of the steps 25 to facilitate entry into the tank. At the top of the end 20, descending steps allow a person to step into the water within the tank. A pair of elongated handrails 28 extend along the tops of the sides 16 and 17; and these handrails are located at a convenient height, typically midway between the waist and shoulders of a person standing in the tank. A raised platform 24, shown in FIG. 1, also may extend along the length of the side 17 of the tank for housing various pumps and other mechanical equipment and for providing a raised surface for a therapist or trainer to stand on when the tank is being used by a person undergoing therapy or physical training within the tank.

As illustrated most clearly in the cross-sectional view of FIG. 3, a motor driven, endless treadmill 30 is mounted in the tank above the bottom 18. The treadmill 30 may be of any suitable type and the mechanism for supporting the treadmill is conventional. Obviously, the rollers and bearings, as well as the material from which the flexible surface of the treadmill 30 is formed, must be suitable for emersion in water. Such treadmill apparatus is commercially available, such as employed in the food processing industry. The treadmill 30 is driven at one end by an electric motor 31 coupled through a conventional belt and pulley (or by a direct drive shaft) to a shaft which extends through water-tight bearings through the wall 17. This is indicated most clearly in the lower right-hand corner of FIG. 6.

The tank 15 is filled with water to a suitable height, typically extending from a height between knee deep and waist deep, and a circulating pump 40, coupled between pipes 36 and 38, creates a flow of water from end of the tank to the other through high volume flow jets or openings 33 and 34 located in the end walls 19 and 20, respectively. The orientation of the flow jets or apertures 33 in the end wall 19 is illustrated most clearly in FIG. 4, and a similar orientation or arrangement of the flow jets or nozzles 34 in the wall 20 also is provided. The pump 40 is interconnected through electrically operated valves 67, 68, 69, and 70, to provide a reversable water flow in a continuous circulating manner from either the end 19 to the end 20, or from the end 20 to the end 19, depending upon the setting of the valves. This operation is described subsequently in conjunction with FIG. 5.

Two other pumps 41 and 42 are interconnected with hydrotherapy nozzles 56 on the side wall 16 and corresponding hydrotherapy nozzles 58 on the side wall 17, as well as a plurality of nozzles 54 and 55 located beneath the upper surface of the treadmill 30. When the pumps 41 and 42 are operated, a typical hydrotherapy mixture of high pressure water and air is directed from the spaced nozzles 56, 58, 54, and 55, to provide a massaging action or turbulance to the general flow of water from end to end in the tank which is provided by the pump 40.

Figure 4:
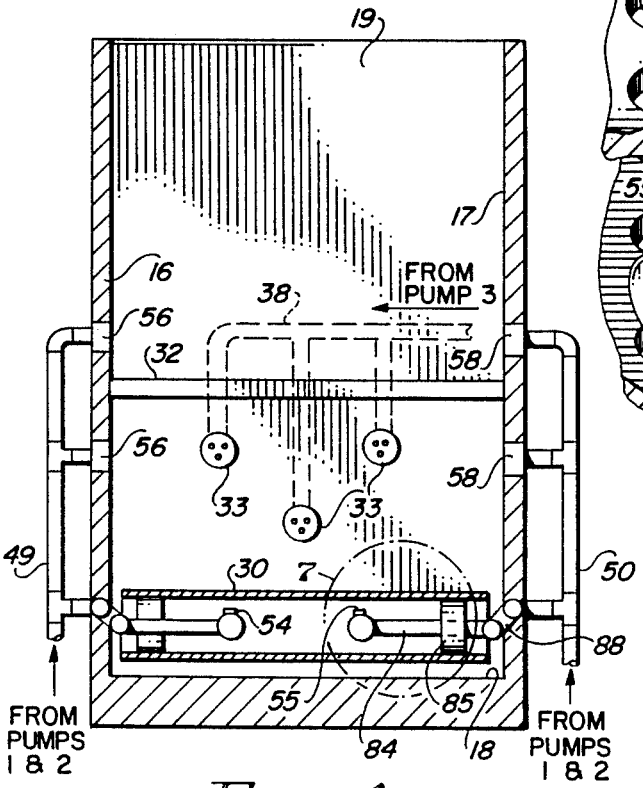
FIG. 4 is a cross-sectional view taken along the line 4—4 of FIG. 3.
Figure 5:
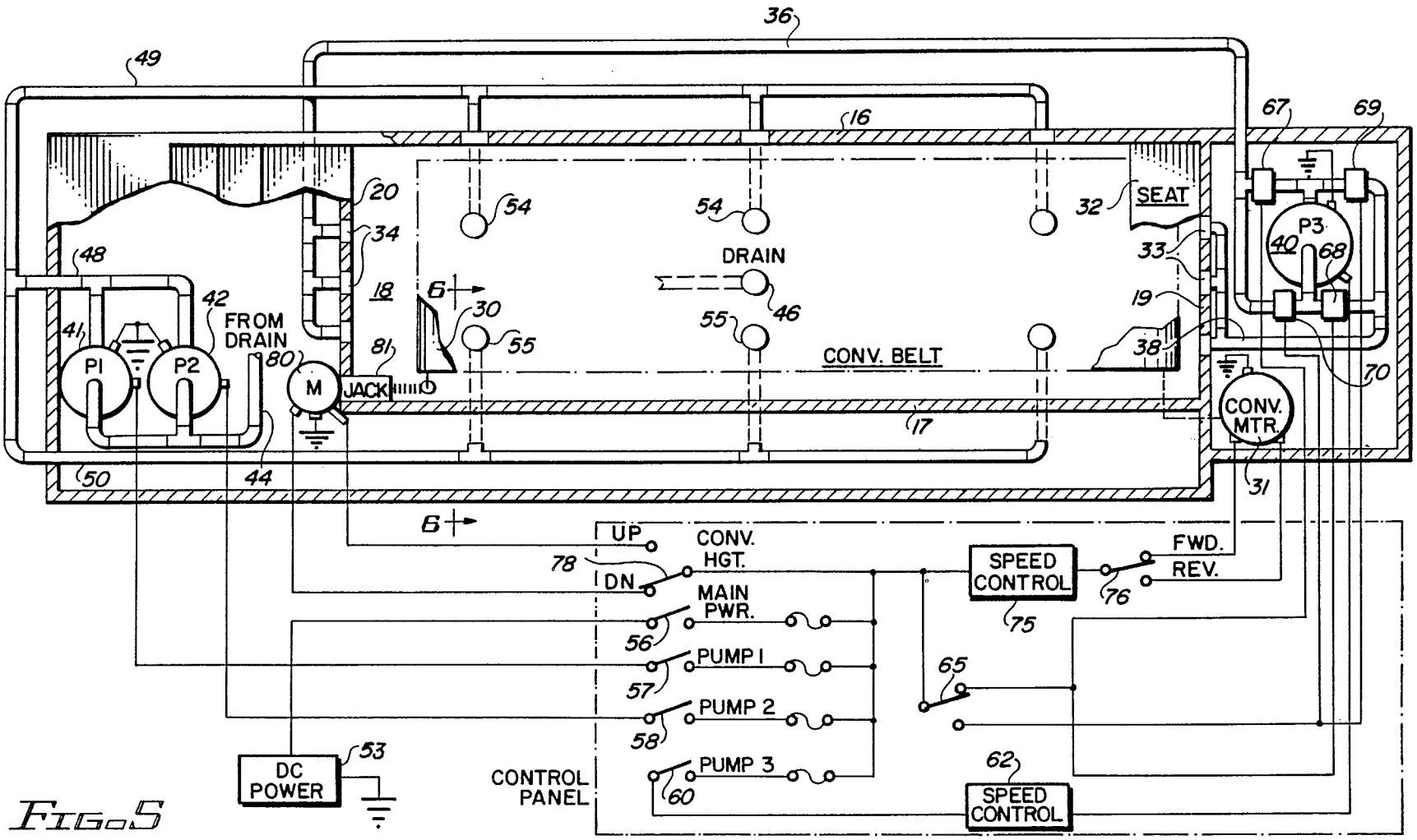
FIG. 5 is a top cross-sectional view taken along the line 5—5 of FIG. 3 and further including a schematic diagram of the control circuitry for operating the various components of the preferred embodiment.

FIGS. 4 and 5 illustrate the plumbing and electrical interconnections of the various pumps 40, 41 and 42, with the different nozzles described above. The treadmill motor 31 and the pumps 40, 41 and 42 all are direct current motors; and operating power for these motors is provided by a suitable direct current power supply 53. The power supply 53 is connected through a main power switch 56 which must be closed to permit operation of the system. The switch 56 may be a single switch, located in a convenient location, or it may constitute a main power switch with series-connected safety switch interrupts located on the top of one or the other of the walls 16 or 17, to permit a person using the device to turn it off in the event of an emergency condition. Once the switch 56 is closed, however, energizing current then is available for operation of the remainder of the electric motors illustrated diagrammatically in FIG. 5.

The motor 31 for driving the treadmill is operated through a speed control device 75, of the type typically used with direct current motors, and through a switch 76 which controls the forward or reverse direction of operation of the treadmill belt 30. Typically, the speed control 75 is selected to be capable of varying the surface speed of the treadmill 30 from zero (0) to seven hundred (700) feet per minute, or a maximum of approximately eight (8) miles per hour. The direction of movement of the upper surface of the treadmill 30 depends upon the setting of the switch 76.

The water flow pump 40 is operated through a switch 60 and a speed control 62 which varies the rate at which the water flow from end to end in the tank is produced by the pump 40. In addition, a switch 65 is used to select the direction of water flow produced by the pump 40. When the switch 65 is in the upper position, as shown in FIG. 5, a pair of valves 67 and 68 are opened to cause the output of the pump 40 to flow through the valve 67 and the line 36, producing a water flow out of the flow jets 34 and into the flow jets 33, with the return flow through the pipe 38 and the valve 68 into the pump 40. The water continuously circulates in this direction, so long as the valves 67 and 68 are opened or operated. The valves 69 and 70 are closed during this mode of operation.

When the switch 65 is moved to contact the lower terminal shown in FIG. 5, the valves 67 and 68 are closed, and the corresponding valves 69 and 70 are opened. When this occurs, the output from the pump 40 flows through the valve 69 and the pipe 38 to enter the tank through the flow jets 33 in the wall 19, and flows from left to right to exit through the flow jets 34 in the wall 20, returning through the pipe 36 and the valve 70 to the pump 40. Thus, it is apparent that the position of the switch 65 determines the direction of the water flow through the tank 15, either from right to left, or from left to right; and the speed control 62 adjusts the rate at which this water flow is produced by the pump 40.

When the switches 57 and 58 are closed, the pumps 41 and 42 are energized to produce a recirculating water flow through a pipe 44 from a drain 46 located at the bottom of the tank underneath the treadmill 30 and outwardly through a pipe 48 connected to a pair of supply pipes 49 and 50 to the various nozzles described above in conjunction with FIGS. 3 and 4. The pumps 41 and 42, and the associated plumbing and nozzles which are connected to them, are standard hydrotherapy recirculating devices of the type commonly used in spas and hydrotherapy tubs.

Figure 7:
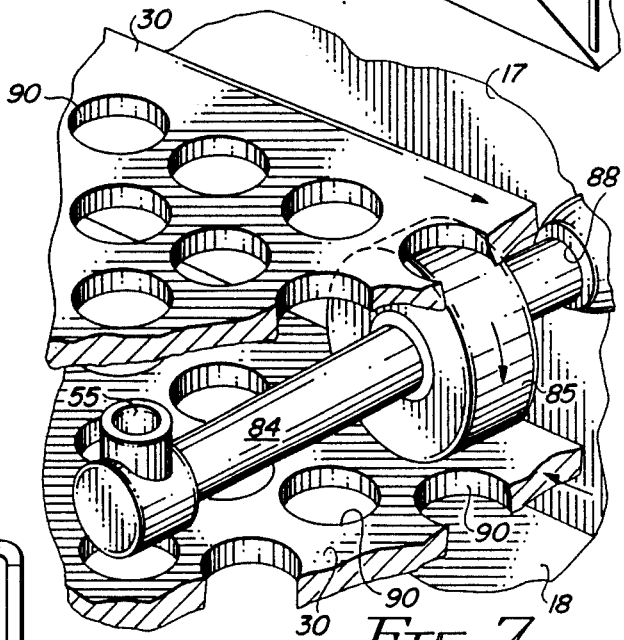
FIG. 7 is a detailed view of a portion of the embodiment circled in FIG. 4.

FIGS. 6 and 7 illustrate details of the belt of treadmill 30, which is constructed of relatively heavy, flexible waterproof material having a large number of circular holes 90 formed in it. These holes extend throughout the length and width of the treadmill 30 and are approximately one inch (1") in diameter. The holes permit the high pressure water and air exiting from the nozzles 54 and 55 to pass upwardly through the treadmill surface to provide a stimulating hydrotherapy effect to the feet and lower legs of persons using the apparatus. The relationship of one of the nozzles 55 to the treadmill 30 and the holes 90 is illustrated most clearly in the enlarged view of FIG. 7.

Another variation of the structure illustrated in FIGS. 6 and 7 is to construct the belt of the treadmill 30 of waterproof material which does not have the circular holes 90 formed in it. The nozzles 54 and 55 then are used to project high pressure water to the underside of the treadmill 30. Sufficient clearance is provided around the edges of the treadmill and the tank to permit this water to flow upwardly past the edges of the treadmill surface. The number of nozzles 54 and 55 and the water pressure are selected to float the surface of the treadmill belt 30 slightly above the standard skid plate while the device is in use. The remainder of the features of the exercise apparatus remain the same as described previously.

This floating of the treadmill belt provides a cushion for the user of the device; and in addition, reduces the horsepower required for the belt drive motor 31. This variation does not provide the hydrotherapy effect to the feet and lower legs which is provided by the utilization of the holes 90 described in conjunction with the belt 30 of FIGS. 6 and 7. An entirely different effect, however, is obtained by the utilization of the water cushion which is particularly useful for persons who use the exercise apparatus for extended periods of time. Obviously, the amount of water pressure produced by the nozzles 54 and 55 required to float the belt 30 in this manner necessarily must be selected in accordance with the parameters of the weight and material of the treadmill belt, as well as the weight of the person or persons who use the exercise apparatus.

For some applications, it may be desirable to raise or lower at least one end of the treadmill 30 to provide an inclined surface and/or to adjust the depth at which the user is submerged in the water in the tank without having to adjust the water level itself. To accomplish this, a motor driven jack 81 is illustrated as connected to the left-hand end roller of the treadmill 30, as illustrated most clearly in FIGS. 3 and 5. The jack 81 extends through a sealed opening in the end wall 20 and is operated by a direct current motor 80. The direction of operation of the motor 80 is selected by the position of a switch 78. When the switch 78 is moved to its upper position, the motor 30 operates the jack 81 to raise the left-hand end of the treadmill 30. When the switch 78 is moved to its lowermost position, the motor 80 reverses to operate the jack to lower the left-hand end of the treadmill 30. Suitable limit switches, not shown, may be provided to turnoff the motor 80 when the extreme limits of its upper and lower positions are reached.

Although a motor driven raising and lowering of the left-hand end of the treadmill 30 is illustrated, manually operated apparatus may be used as well, if desired. By providing the capability of inclining the treadmill 30, a further degree of utilization of the device as a conditioning and hydrotherapy device is possible.

As illustrated in FIG. 6, the surface of the treadmill 30 also may include uniformly spaced stripes 91 of a contrasting color. These stripes permit a person using the device to determine the direction of movement of the treadmill and the relative speed of operation through the water. For a treadmill which is operated out of water, such stripes are not particularly significant. Because of ripples in the water and the like, however, it sometimes is difficult to ascertain the movement of the treadmill, so the stripes 91 of a highly contrasting color are employed as a safety feature.

Since the jack 81 may be employed to raise and lower the end of the treadmill, it is necessary to mount the nozzles 54 and 55 (which are located within the space between the upper and lower portions of the endless belt treadmill 30), through a flexible coupling device which permits this spacing to be maintained and prevent interference of the treadmill 30 with the nozzles 54 and 55. This is done by means of utilizing flexible couplings 88 through the side walls 16 and 17 connected to pipes 84 which are suspended mid-way between the upper and lower surfaces of the treadmill belt by means of rollers 85 journaled on bearings extending over the pipes 84. This structure is illustrated most clearly in FIG. 7. Other constructions for permitting this function also may be employed, if desired.

In the use of the device described above and illustrated in FIGS. 1 through 7, a wide variety of fitness and therapeutic functions are possible. For example, for working with athletes or individuals who are already at a relatively advanced level of physical condition or training, the treadmill 30 and the water flow typically are run in the same direction. For example, the upper surface of the treadmill 30 moves from right to left, as illustrated in FIGS. 1 and 3, and the water flow produced by the pump 40 also moves from the wall 19 to the wall 20 through the openings 33 and 34 to produce a water flow parallel to the movement of the treadmill 30. The speed at which the treadmill 30 is operated and the rate of flow of the water may be adjusted together or independently of one another to select the desired level of workout for the fitness level of the person who is using the apparatus for athletic training purposes or as a fitness workout.

In another mode of operation, however, the apparatus may be used as a therapeutic device to assist a person in relearning how to walk after an accident, a stroke, or an operation. Used in this manner, typically the treadmill 30 is operated in one direction with the water flow in the reverse direction. For example, the treadmill 30 may be continued to operate to cause the upper surface to move from right to left, as shown in FIGS. 1 and 3. The switch 65, however, is reversed to cause the pump 40 to supply water through the line 36 and the flow jets 34 to flow from the left-hand end wall 20 through the tank to the right-hand end wall 19 in a recirculating manner. When this is done, the person who is being rehabilitated simply has to raise his foot up, and the water flow then helps move the foot forward by with the pushing action of the water circulating from the left end to the right end of the tank (this is assuming that the person is facing toward the right, as viewed in FIGS. 1 and 3). Once the foot has moved one step forward, the person then lowers the foot to the surface of the treadmill 30, which brings the leg backwards (toward the left), thereby creating a walking motion while the person is standing perfectly still, holding onto the railings 28. At the same time, the buoyant effect of the water, which typically is at least waist deep, reduces the body weight on the joints and muscles; so that the desired conditioning of the muscles and joints is effected without any undue stress. The treadmill and the water flow speeds both are independently variable to permit an individual to adjust the level of workout to the desired therapy level.

The tank 15 also is illustrated with a seat 32 across the end 19. A person recovering, for example, from a knee injury, or a person who is confined to a wheel chair, may be placed by a therapist or other assistant, on the seat 32, with the legs dangling downward. Once again, with the water flow traveling in one direction and the treadmill in another, a therapeutic movement or exercising of the knee, may be effected without undue stress. For example, when the tank is used in this manner, the switch 76 for the drive motor 31 of the treadmill is placed in the reverse or lower direction to cause the upper surface of the treadmill to move from left to right, as viewed in FIGS. 1 and 2. The water flow of the pump 40 is selected to move the water from right to left (end wall 19 to end wall 20).

As illustrated in FIG. 3, the water enters into the tank immediately beneath the seat 32. Thus, the water tends to push the legs of the person outwardly or swing them outwardly as a person is sitting on the seat 32. When the person using the device then touches his or her toes downwardly onto the surface of the treadmill 30, the treadmill 30 moves the foot backward toward the wall 19, where rotating the ball of the foot upwardly slightly releases the foot from the treadmill to thereby permit the water flow once again to swing the leg outwardly. This utilization of the apparatus permits early therapeutic exercise to greatly facilitate the recovery of persons who have undergone knee surgery. This is particularly significant with respect to athletes who frequently undergo such surgery, and the therapeutic effect, beginning with the simple swinging motion of a person sitting on the seat 32, followed by the therapeutic walking motion of a person standing on the treadmill 30, as described above, shortens the recovery time and results in more complete recovery than has been possible without the use of the apparatus described above.

The tank of FIG. 2 is similar to the one of FIG. 1, except that it has been modified to show placement of the jack motor and the pump motors 41 and 42 in the region beneath the steps 25 behind an access panel 95. In addition, a wheel chair ramp 96 is provided at the right-hand end, with suitable steps descending downwardly from an upper surface to permit a therapist or other person to assist wheel chair patients in entering into and using the tank. Handrails 97 are provided on each side of the ramp 96, the slope of which is exaggerated in FIG. 2. Otherwise the tank of FIG. 2 is operated in the same manner as the tank of FIG. 1.

A variation of the apparatus is illustrated in FIGS. 8 through 10. The apparatus of FIGS. 1 and 2 typically is used for one to three persons. When three persons use the tank at the same time, they are located one behind the other. If the middle person, for example, desires the leave the tank, generally the treadmill 30 is stopped and the pump 40 is stopped to permit such a person to move past the others to leave the tank. FIG. 8 illustrates a different arrangement in which as many as five persons may simultaneously use the tank. This arrangement permits any of these persons to enter or leave the tank at any time without interferring with the others. The basic apparatus is the same, except that the tank has a series of steps 105 extending from a platform 103 located along the back wall, or what constitutes the wall 16 of the tank of FIGS. 1 and 2. A handrail 102 extends from the handrail 27 on the left-hand end, and from the handrails 97 adjacent the wheel chair ramp 96 on the right-hand end of the tank. All of the operating mechanism for the pumps, the treadmill 30, and the hydrotherapy jets operated by the pumps 41 and 42 are the same for the device of FIGS. 8 through 10, as for the devices of FIGS. 1 through 7 described above. Consequently, no further description of the operation of those devices is considered necessary here.

Each of the steps 105 has a pair of handrails 108 located adjacent the steps to permit a person to step downwardly into the water of the tank from the raised platform 103. The treadmill 30 extends along the bottom of the tank at the bottom of each of the steps 105, as shown most clearly in FIG. 9. Upper and lower sets of handrails 109 and 111 are provided, and a person using the tank faces one end or the other, standing on the treadmill 30, which is operated in any of the various modes which have been described above in conjunction with FIGS. 1 and 2.

In addition, however, the hydrotherapy nozzles 54, 55, 56, and 58, are supplemented with additional nozzles 116 located in and adjacent to the intermediate step of each of the set of steps 105. This permits a person to sit on the steps and obtain hydrotherapy massage of the legs without utilizing the treadmill 30, if desired. A person standing on the treadmill 30, however, receives a hydrotherapy massage from the various nozzles 54, 55, 56, and 58, which are located in positions approximately the same as in the embodiments of FIGS. 1 and 2.

The foregoing descriptions of the preferred embodiments are to be considered illustrative only and not as limiting. Various changes and modifications will occur to those skilled in the art without departing from the true scope of the invention. Obviously, different configurations other than the three which have been described in conjunctions with FIGS. 1, 2 and 8, may be employed if desired. The relative size of the apparatus and the specific structure of the treadmill may be varied by those skilled in the art. Different plumbing and pump arrangements may be employed, as desired, while remaining within the true scope of the invention as defined in the appended claims.

I claim:

1. An aquatic exercising and therapeutic apparatus including in combination:

a container for retaining liquid to a predetermined depth, said container having a bottom, first and second opposite sides, and first and second opposite end walls;

treadmill means located in the bottom of said container and extending substantially between said first and second end walls for movement from one of said first and second end walls to the other of said first and second end walls; and means for producing a continuous flow of liquid independently of movement of said treadmill means substantially from one of said first and second end walls to the other of said first and second end walls.

2. The combination according to claim 1 wherein said treadmill means includes an endless belt means and a treadmill drive means for driving said endless belt means.

3. The combination according to claim 2 wherein said means for producing flow of liquid from one of said first and second end walls to the other of said first and second end walls comprises flow jets located in each of said first and second end walls, a pump having an inlet and an outlet, and means for coupling said flow jets in said one of said first and second end walls with the outlet from said pump and for coupling said flow jets at the other of said first and second end walls with the inlet to said pump.

4. The combination according to claim 1 further including means for varying the height of at least one end of said treadmill means relative to the bottom of said container.

5. The combination according to claim 1 further including means for varying the speed of operation of said treadmill means.

6. The combination according to claim 5 further including means for varying the rate of flow of said liquid from one of said first and second end walls to the other of said first and second end walls.

7. The combination according to claim 6 wherein said treadmill means includes an endless belt means and a treadmill drive means for driving said endless belt means.

8. The combination according to claim 7 further including reversing means for causing said flow of liquid and said treadmill means to move in the same direction in a first state of operation and for causing said flow of liquid and said treadmill means to move in opposite directions in a second state of operation.

9. The combination according to claim 7 wherein said endless belt means is provided with apertures therethrough and further including means for injecting fluid upwardly from beneath said endless belt means for providing turbulance upwardly through said apertures.

10. The combination according to claim 1 further including a plurality of spaced-apart nozzles in at least one of said sides; and means for supplying fluid under pressure to said nozzles.

11. The combination according to claim 10 wherein said spaced-apart nozzles are provided in each of said first and second sides of said container.

12. The combination according to claim 1 wherein said treadmill means has a length sufficient to permit simultaneous use thereof by more than one person.

13. The combination according to claim 1 further including means for varying the rate of flow of said liquid from one of said first and second end walls to the other of said first and second end walls.

14. An aquatic exercising and therapeutic apparatus including in combination:

a container for retaining liquid to a predetermined depth, said container having a bottom, first and second opposite sides, and first and second opposite end walls;

treadmill means including an endless belt means located in the bottom of said container, and means for driving said endless belt means, said belt means extending substantially between said first and second end walls;

means for producing a continuous flow of liquid substantially from one of said first and second end walls to the other of said first and second end walls;

means for producing a continuous flow of liquid from one of said first and second end walls to the other of said first and second end walls comprising flow jets located in each of said first and second end walls, a pump having an inlet and an outlet, and means for coupling said flow jets in said one of said first and second end walls with the outlet from said pump and for coupling said flow jets at the other of said first and second end walls with the inlet to said pump; and reversing means for causing said flow of liquid and said treadmill means to move in the same direction in a first state of operation and for causing said flow of liquid and said treadmill means to move in opposite directions in a second state of operation.

15. The combination according to claim 14 further including means for varying the speed of operation of said treadmill means.

16. The combination according to claim 14 further including means for varying the rate of flow of said liquid from one of said first and second end walls to the other of said first and second end walls.

17. The combination according to claim 16 wherein said reversing means comprises means for reversing the direction of said flow of liquid between said first and second end walls.

18. The combination according to claim 17 further including means for changing the depth of the liquid in said container above the surface of said treadmill means.

19. The combination according to claim 18 wherein said means for changing the depth of the liquid comprises means for varying the height of at least one end said treadmill means relative to the bottom of said container.

20. The combination according to claim 19 further including a plurality of spaced-apart nozzles in at least one of said sides; and means for supplying fluid under pressure to said nozzles.

21. The combination according to claim 20 wherein said endless belt means is provided with apertures therethrough and further including means for injecting fluid upwardly from beneath said endless belt means for providing turbulance upwardly through said apertures.

22. The combination according to claim 21 wherein said spaced-apart nozzles are provided in each of said first and second sides of said container.

23. The combination according to claim 22 wherein said treadmill means has a length sufficient to permit simultaneous use thereof by more than one person.

24. The combination according to claim 23 wherein said container is located above ground and further including means for facilitating entrance and exit from said container.

25. An aquatic exercising and therapeutic apparatus including in combination:

a container for retaining liquid to a predetermined depth, said container having a bottom, first and second opposite sides, and first and second opposite end walls;

treadmill means located in the bottom of said container and extending substantially between said first and second end walls;

means for producing a continuous flow of liquid substantially from one of said first and second end walls to the other of said first and second end walls; and reversing means for causing said flow of liquid and said treadmill means to move in the same direction in a first state of operation and for causing said flow of liquid and said treadmill means to move in opposite directions in a second state of operation.

26. The combination according to claim 25 wherein said reversing means comprises means for reversing the direction of said flow of liquid between said first and second end walls.

* * * * *